United States Patent [19]

Brown

[11] 4,337,694

[45] Jul. 6, 1982

[54] SYSTEM FOR HANDLING AND BALING METALLIC SCRAP MATERIAL

[76] Inventor: Stanford M. Brown, 1647 Thornapple River Dr., SE., Grand Rapids, Mich. 49506

[21] Appl. No.: 278,629

[22] Filed: Jun. 29, 1981

Related U.S. Application Data

[62] Division of Ser. No. 108,508, Dec. 31, 1979.

[51] Int. Cl.[3] ..... B30B 9/32

[52] U.S. Cl. ..... 100/45; 100/91; 100/94; 100/99; 100/215; 100/232

[58] Field of Search ..... 100/45, 91, 94, 99, 100/215, 232, 98 R, 42; 198/505; 177/120, 121

[56] References Cited

U.S. PATENT DOCUMENTS

| | | | |
|---|---|---|---|
| 769,692 | 9/1904 | Davies | 100/215 |
| 1,293,124 | 2/1919 | Korte | 100/98 R |
| 2,340,030 | 1/1944 | Weyandt | 198/505 |
| 2,748,694 | 6/1956 | Thompson | 100/232 |
| 2,997,942 | 8/1961 | Dunham | 100/42 |
| 3,093,203 | 6/1963 | Frost | 177/120 |
| 3,266,096 | 8/1966 | Thomas | 425/330 |
| 3,386,374 | 6/1968 | Tezuka | 100/215 |
| 3,498,395 | 3/1970 | Henry | 177/121 |
| 3,765,321 | 10/1973 | Newell | 100/45 |
| 4,040,230 | 8/1977 | Pessel | 100/99 |

OTHER PUBLICATIONS

Brochure–Harris Press and Shear Corp., pp. 1–8, Apr. 1973.

*Primary Examiner*—Billy J. Wilhite

*Attorney, Agent, or Firm*—Price, Heneveld, Huizenga & Cooper

[57] ABSTRACT

A system including a combination of apparatuses for handling and baling metallic scrap material nominally into cubes in which a vibrating shaker conveyor hopper assembly, a conventional baling press modified by mounting a dumping hopper on its side, and a belt-type conveyor located between the shaker and dumping hoppers are provided. The scrap material is transferred by a front loader from a storage pad and dumped into the stationary hopper of the vibrating shaker conveyor hopper assembly, the said hoppers, conveyors, and baling press all being operatively interconnected to provide a continuous operative system which can be continuously fed by the front loader. Preferably at the discharge end of the shaker conveyor, a grate is provided to sift out dirt, grit and other extraneous material which falls onto and is carried away to a storage pad or container by a transverse conveyor.

9 Claims, 13 Drawing Figures

SYSTEM FOR HANDLING AND BALING METALLIC SCRAP MATERIAL

This is a division of application Ser. No. 108,508, filed Dec. 31, 1979.

BACKGROUND OF THE INVENTION

This invention relates to a system including apparatus for handling metallic scrap material and baling the same nominally into cubes for subsequent melting into molten metal.

The present day apparatus for handling and baling medium sized pieces of metallic scrap material have included the piling of such scrap material on a large pile adjacent a baling press and feeding the press with large and expensive cranes that pick up the material magnetically or by means of a grabbing bucket or claws that lift the material and transfer it over and dump it into the opening to the charge box of the baling press. The presses used in such systems are capable of compacting the material from one or more different directions (generally three directions), so as to compress the raw material into a bale which is then ejected from the press. One such press is that being manufactured and sold by the Harris Press and Shear Corporation of St. Paul, Minn. In some instances, the presses have located directly over the charge box a weigh hopper which weighs the amount of the material and automatically dispenses the same into the baling press in response to a certain weight activating the baling cycle.

The known systems with the apparatus as above described is very expensive, particularly because of the cost of the crane. Also, such systems are relatively slow as a result of limitations of the baling press operator and the limitations of the crane and its operator. Accordingly, the known systems, which utilize a baling machine having a manufacturer's rated capacity of a 40-second cycle to compress the material in all three directions and dispense the material in the shape of a cube, usually takes one minute and thirty to forty seconds to complete the production of one cube. This excess production time is caused by the human factor.

I have conceived of an entirely new system, which, although it is comprised of well-known components, produces a bale in one minute or less. Further, the apparatus used in this system is substantially less expensive.

SUMMARY OF THE INVENTION

In accordance with my invention, I provide an area, preferably comprising a concrete pad where the metallic scrap material to be baled is dumped and stored as it is received by trucks or the like from the manufacturing plants. Located at a short distance from this pad is a stationary hopper having a shaker or vibrating conveyor in the bottom thereof which conveys the metallic scrap material from one end to another. The hopper is accessible preferably from at least three sides to accommodate the dumping of the scrap material by a front loader vehicle. Thus, the front loader vehicle picks up the metallic scrap material from the storage pad, carries it to the stationary conveyor hopper, and dumps it in the hopper.

Located at a distance from the hopper conveyor is a baling press of the type previously referred to and which has an opening to a charge box for receiving metallic scrap material.

In accordance with my invention, I provide at the side of the baling press immediately adjacent the charge box of the press a weigh hopper pivotally mounted along one of its sides adjacent the baling press. This weigh hopper is pivotally actuated by a hydraulic cylinder adapted to cause the weigh hopper to be pivotally actuated for dumping the contents of such weigh hopper into the charge box of the bale press. The weigh cell is provided under the weigh hopper for sensing a predetermined weight of material in the hopper to control the actuation of the hydraulic cylinder in response to such predetermined weight in the weigh hopper.

A second conveyor means is provided between the shaker conveyor and the weigh hopper for conveying and elevating the material conveyed from the shaker conveyor into the weigh hopper. Controls are provided for controlling the two conveyors and the baling press in response to the weight of the material in the weigh hopper and its relative position with respect to the elevator conveyor. In a preferred form of my invention, I provide at the very exit end of the hopper conveyor a grate through which the undesirable, extraneous fine material can fall. I also provide underneath this grate another conveyor for conveying such undesirable materials to a pad of concrete from which such material can be carried away. In the preferred form, a portable container located upon this concrete pad would receive such material.

This system and the apparatus used therein and all of the important advantages thereof will be understood and appreciated by those skilled in the art by reference to the following written specification in conjunction with the appended drawings.

DETAILED DESCRIPTION OF THE PREFERRED EMBODIMENT

Figure 6:
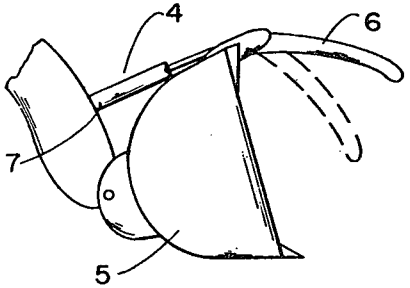
FIG. 6 is a cross-sectional view of the bucket of the front loader utilized in this invention.
Figure 1:
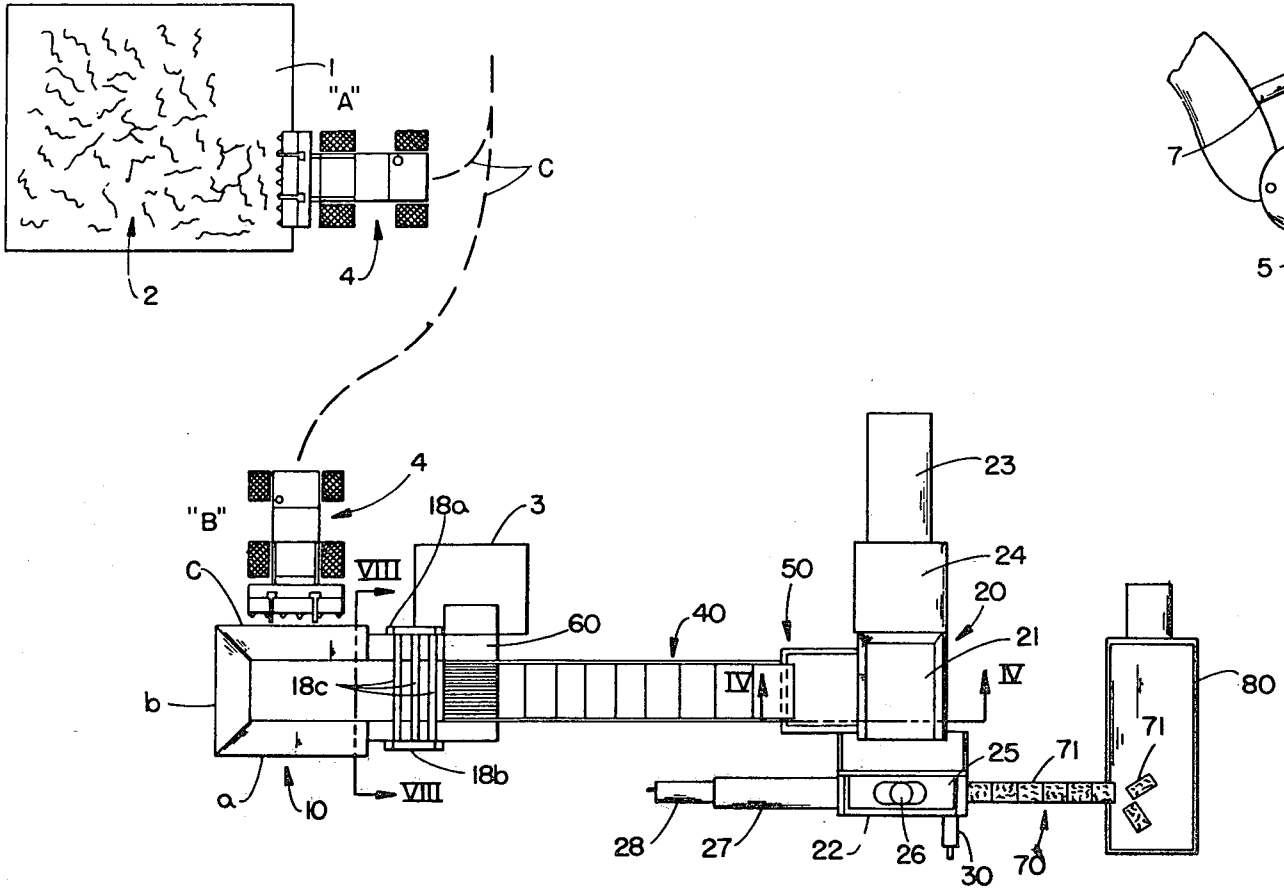
FIG. 1 is a plan view in schematic form of the system of this invention and the apparatus utilized therein.
Figure 2:
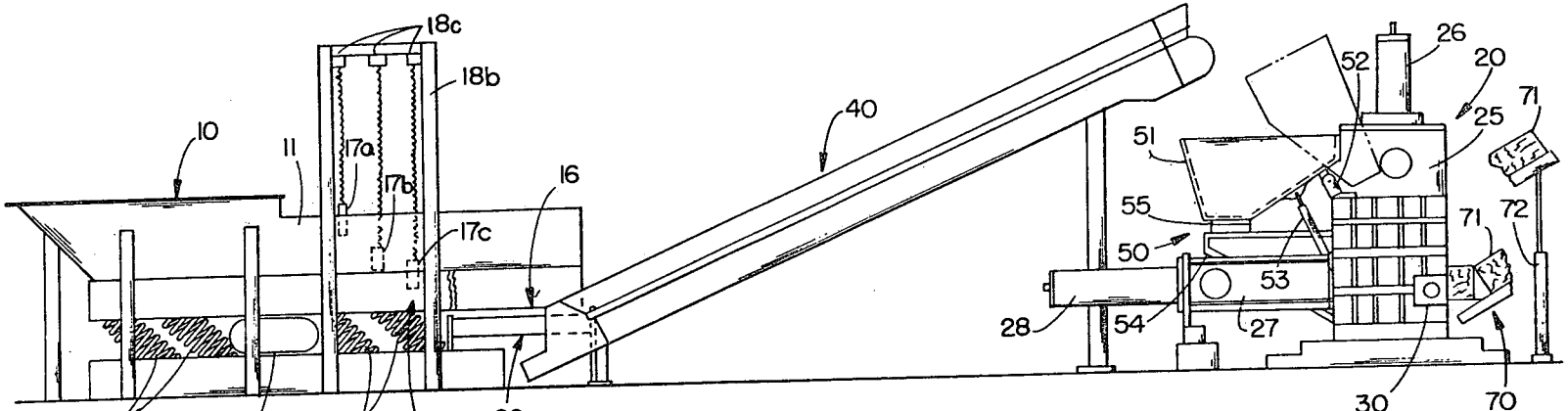
FIG. 2 is a side elevational view of a part of the apparatus as disclosed in FIG. 1.
Figure 3:
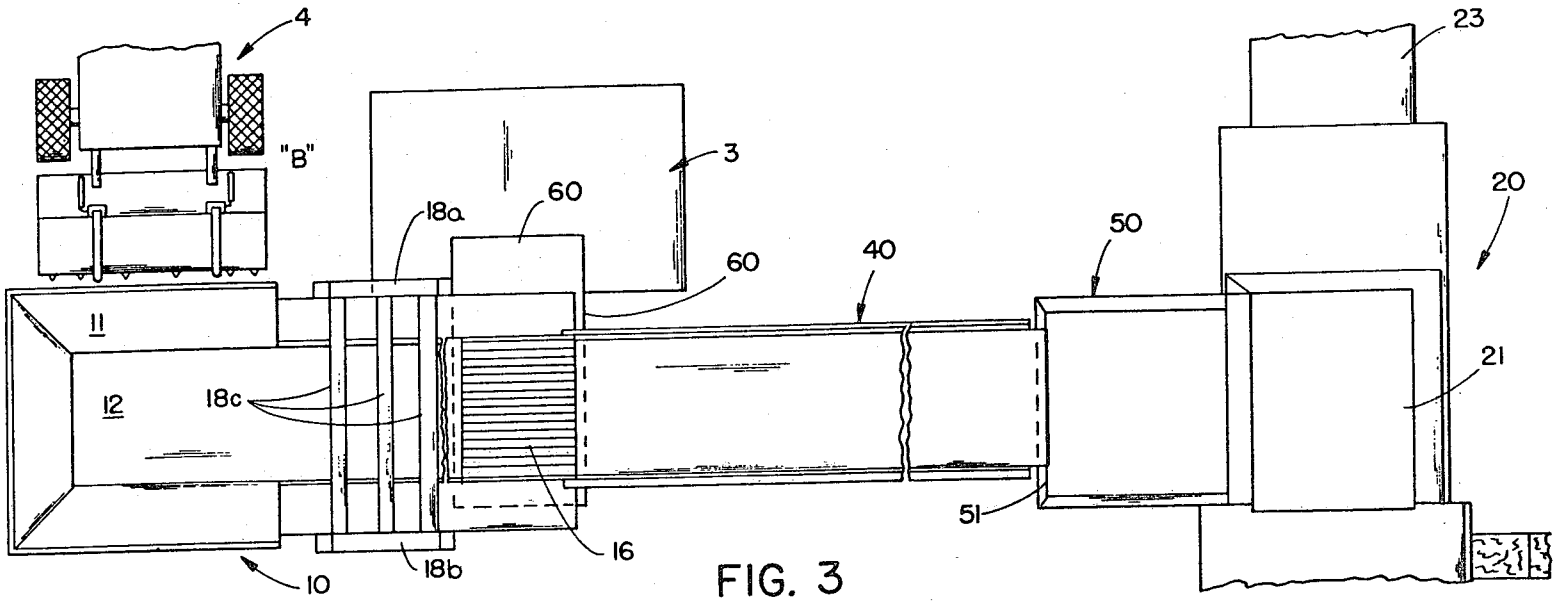
FIG. 3 is an enlarged plan view of that portion of the apparatus of FIG. 2 with certain parts thereof cut away.

Referring to the drawings and particularly FIGS. 1, 2 and 3, this system includes the concrete pad 1 on which the metallic scrap material 2 is dumped as it is received from the manufacturing plants. Located at a distance from the pad 1 is the shaker conveyor hopper 10, the baling press 20 and the elevator conveyor or belt conveyor 40 extending from the exit of the shaker conveyor of hopper 10 above the weigh hopper assembly 50. Located under the exit end of the shaker conveyor is the cross-conveyor 60 which leads to another storage pad 3 constructed preferably of concrete. Also, as disclosed in FIGS. 1 and 3, the front loader vehicle 4 is specifically provided to transfer the material from the pad 1 to the shaker conveyor hopper 10.

The storage pad 1 for the metallic scrap material 2 is a pad having a flat surface over which the bucket 5 of the front loader vehicle 4 can slide to pick up the material. The preferred bucket 5 is of the type which is provided with the hydraulically actuated grapple arms 6 actuated by the cylinders 7 for grabbing onto the material and holding it in the bucket as the material is transferred from the position A to position B along the path C as disclosed in FIG. 1. Front loader 4 is capable of lifting the material to a height above the shaker hopper 10 where it is released and dumped into the hopper 10.

The hopper 10 as disclosed in FIGS. 1, 2, 3 and 8 includes the top hopper portion 11 and a lower shaker conveyor portion 12. The upper hopper portion 11 is supported by the posts 13 and is unconnected and free-standing from the lower shaker conveyor while the lower shaker portion 12 is supported by the springs 14. A shaking mechanism 15 is operatively connected to the lower shaker portion 12 for vibrating or shaking the portion 12 to cause the material deposited into the hopper to flow at a preferred rate of 20 feet per minute in a direction toward the right as viewed in FIGS. 1, 2 and 3. At the exit end of the conveyor portion is a section 16 constructed of grates that provide openings through which undesirable small particles such as dirt, grit, and the like will fall before the scrap material reaches the elevator conveyor 40.

Associated with the hopper for breaking up the material on the conveyor, in order to level off the material and prevent jam ups, are the breaker bars 17*a*, 17*b*, and 17*c* hanging from a guillotine type of support which includes the uprights 18*a* and 18*b* and cross bar 18*c*. The bars 17*a*, 17*b* and 17*c* are each secured to chains 19 which permit the bars to swing.

Figure 4:
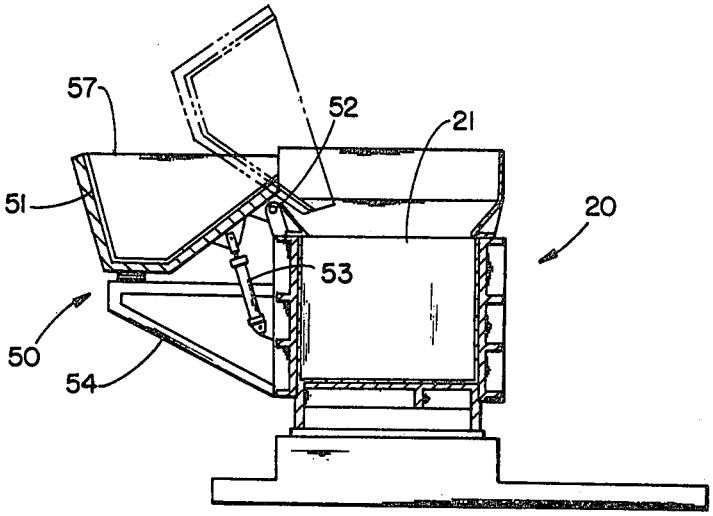
FIG. 4 is a side-elevational, cross-sectional view taken along plane IV—IV of FIG. 1 of the combination bale press and weigh hopper and illustrating in phantom line the position of the weigh hopper when in dumping position.

Shown in schematic form in FIGS. 2, 3 and 4 is a conveyor 60 which can be a belt conveyor or a shaker or vibrating conveyor that catches the undesirable materials passing through the grates of the end section 16 and conveys such materials to the pad 3 from whence such materials can be removed by any conventional means.

The baling press 20 is, as previously disclosed, a conventional type of press such as manufactured and sold by Harris Press and Shear Corporation of St. Paul, Minn. This press includes a charge box 21 having a top opening into which the material to be baled is dumped. A first compression ram (not shown) located in chamber 22 and actuated by compression cylinder 23 is provided for moving through the charge box 21 and compressing the material into a chamber 22. A second compression ram (not shown) located in the chamber 25 above the chamber 22 and actuated by a second compression cylinder 26 provides a means for compressing the material from the top in the chamber 22. A third compression ram (not shown) located in the chamber 27 and actuated by the compression cylinder 28 is provided for compressing the material in a third direction within the chamber 22 against the bale door 29.

Figure 5A:
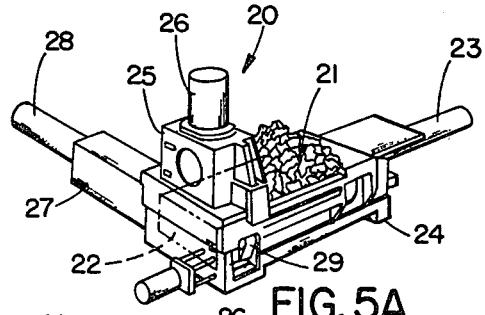
FIGS. 5A through 5F, inclusive, are perspective views of the conventional baling press utilized in this invention and demonstrating the cycle of the baling press after a load of material is dumped into the charge box.
Figure 5D:
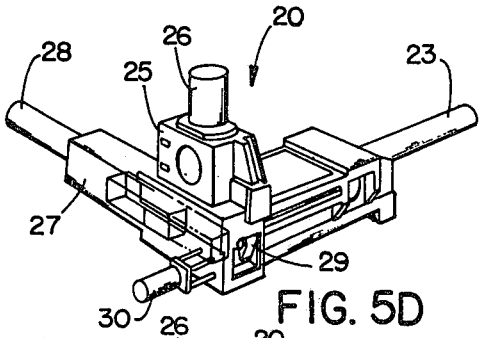
Figure 5B:
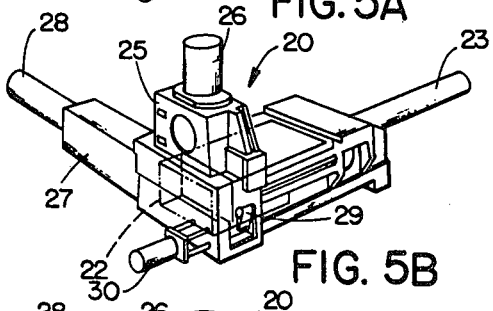
Figure 5E:
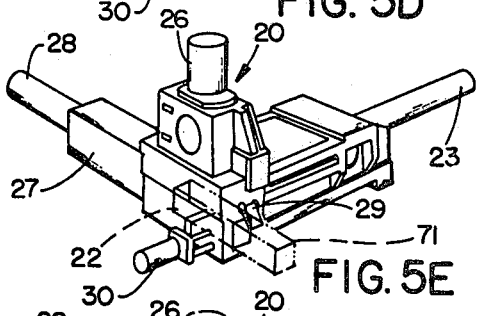
Figure 5C:
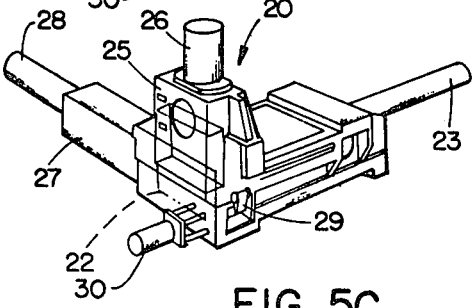
Figure 5F:
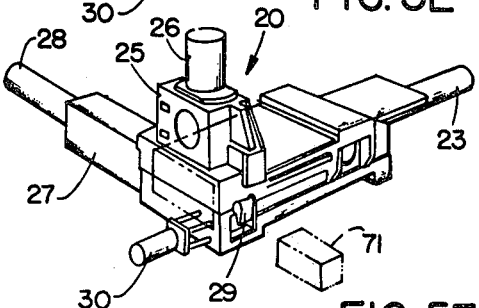
FIG. 5F PRIOR ART

It should be understood that this bale press 20 is of the conventional type and operates as disclosed in FIGS., 5A, 5B, 5C, 5D, 5E and 5F. For example, FIG. 5A shows the baling press with the charge box full of metallic scrap material. In FIG. 5B, the first compression ram has been actuated by the first compression cylinder 23 forcing and compacting the material within the chamber. FIG. 5C illustrates the next step of the cycle in which the second compression ram is actuated by the second compression cylinder 26 causing the material to be forced downwardly and compacted in the chamber 22. The next step as illustrated by FIG. 5D is the actuation of the third compression ram by the third compression cylinder 28 forcing the scrap material against the bale door or gate 29 to thus compact the material in a third direction. When this step is completed the cylinder 30 opens the gate 39 as disclosed in FIG. 5E and the third compression ram forces the bale 31 out of the chamber 22 to complete the cycle. Then, as disclosed in FIG. 5F, all of the compression rams are returned to their original position rendering the charge box open and ready to receive the next batch of material to be baled.

The charge box is filled by the weigh hopper assembly 50 which includes the hopper 51 pivoted about the axis 52 by means of a hydraulic cylinder 53. Located under the hopper and mounted on the frame 54 is the weigh cell assembly 55 capable of sensing when a predetermined amount of metallic scrap material is in the hopper 51. As will be described hereinafter, the cylinder 53 is actuated in response to the weigh cell assembly 55 sensing such predetermined weight of material in the hopper 51.

As best disclosed in FIG. 4, the hopper is shaped so that when it is tipped as disclosed by the phantom lines, all the material therein is dumped into the charge box 21 of the baling press. However, when it is in the rest or receiving position as disclosed in solid lines, the hopper has a top opening 57 for receiving material from the elevator conveyor 40.

The elevator conveyor 40 is preferably a belt type conveyor extending from the conveyor of the shaker hopper over the top opening 57 of the hopper 51. The elevator conveyor 40 is of the belt type with transverse steel slats but in some instances could be a shaker conveyor. Such belt can be of any well-known construction sufficiently rugged to stand the wear and tear in the handling of metal scrap products. The conveyor 40 is operated to convey the material at a preferred rate of 60 feet per minute so that the material will be spread out by reason of its greater speed than the shaker conveyor portion 12 of hopper 10. The motor (not shown) for driving conveyor 60 is controlled in conjunction with the operation of a shaker conveyor of hopper 10, the hopper assembly 50, and the baling press 20, all of which are operatively connected together as now will be explained.

Figure 7:
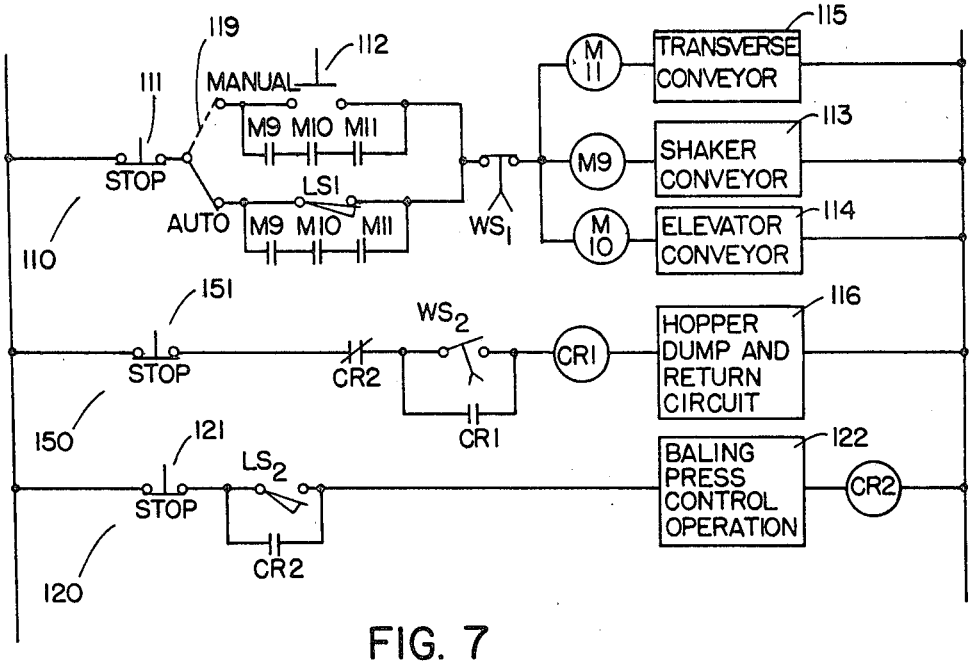
FIG. 7 is a simplified electrical schematic of the means for controlling various apparatus of the present system.
Figure 8:
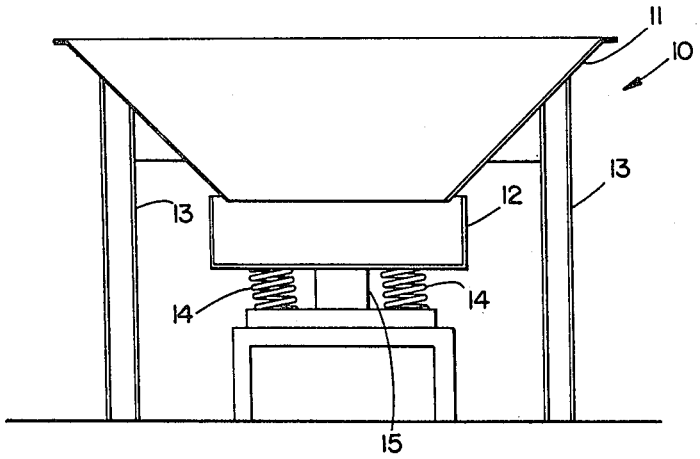
FIG. 8 is a cross-sectional view taken along the plane VIII—VIII of FIG. 1 of the shaker conveyor utilized in this invention.

FIG. 7 is a simplified electrical schematic disclosing how the operation of the shaker conveyor of hopper 10, the elevator or belt conveyor 40, the dump hopper assembly 50, and the baling press are operatively interconnected. The schematic discloses the conveyor control circuit 110, the dump hopper control circuit 150 and the baling press control circuit 120.

The conveyor control circuit 110 includes the stop switch 111, the selector switch 119, the start switch 112, the weight switch contacts WS1, and the limit switch contacts LS1, connected with the parallel circuits including the shaker conveyor motor 113 and holding relay coil M9, the elevator conveyor motor 114 connected in series with the holding relay coil M10, and the transverse conveyor motor 115 in series with the holding relay coil M11. The holding relay coils M9, M10 and M11 control the opening and closing of the contacts M9, M10 and M11, respectively, which bypass the start switch 112.

The dump hopper control circuit 150 includes the stop switch 151, the normally closed relay contact CR2, the weight switch contact WS2 of the weigh cell assembly 55, the relay coil CR1 and the so-called, hopper dump and return circuit 116 which controls the actuation of the cylinder 53 and causes the hopper to dump and return to its rest position.

The baling press control circuit 120 includes the stop switch 121, the limit switch contacts LS2, the baling press operation circuit 122 and the relay coil CR2. Bypassing the limit switch contacts LS2 are the relay contacts CR2.

OPERATION

In operating the apparatus as controlled by the circuitry of FIG. 7, the entire apparatus is put into operation by first setting the selector switch 119 in either manual or automatic mode. In the automatic mode the cycles are automatically repeated while in the manual mode each cycle has to be initiated manually. If in manual mode, the start switch 112 is closed. This can be done by hand or could be radio operated by the operator of the front loader 4. If in automatic mode, the circuit is closed through limit switch LS1, switch contacts WS1, the holding coils M9, M10 and M11, and the shaker conveyor, elevator conveyor, and transverse conveyor motors 113, 114 and 115. The energization of the coils M9, M10 and M11 closes the contacts M9, M10 and M11, thereby bypassing the limit switch LS1.

It should be realized that the weight switch or contacts WS1 are part of the weigh cell assembly 55 and are closed so long as the weight of the metallic scrap material in the hopper 51 is below a predetermined amount which is to constitute the weight of a single bale to be formed by the baling press 20. The limit switch LS1, located in a position (not shown) relative to the hopper 51, is also normally closed while the hopper 51 is in the rest or receiving position as disclosed in solid lines in FIGS. 2 and 4. With the circuit 110 closed through the shaker conveyor motor 113, the elevator conveyor motor 114, and the transverse motor 115, the material which is dumped into the hopper 10 is carried along by the shaker bed or portion 12 in a direction toward the grated portion 16 thereof. As it is so conveyed, the breakers level off the material and prevent jamming. When the material reaches the grated portion 16, all of the small undesirable materials such as dirt and grit passes through its openings and onto the conveyor 60 which carries such extraneous material in a transverse direction to the pad 3.

The operation of the conveyors continues resulting in the dumping of the metallic scrap material into the hopper 51. The filling of the hopper continues until such time as a predetermined weight of the scrap material in the hopper is reached causing the contacts WS1 of the weigh cell assembly 55 to open and the contacts WS2 of the weigh cell assembly 55 to close.

Immediately upon closing of the contacts WS2, the hopper dump and return circuit 116 comes into operation. Thus, the cylinder 53 is actuated causing the hopper to pivot to the position shown in phantom and to dump the scrap material in the hopper 51, into the charge box 21 of the baling press 20. The circuit 116 then causes cylinder 53 to permit the return of the hopper back to its rest position as shown in FIGS. 2 and 4 in which position and with no scrap material in the hopper, the weight switch contacts WS1 close and the weight switch contacts WS2 open. Further, the limit switch LS1, which is open while hopper 51 is dumping, is closed causing the conveyors to operate and again automatically start filling the hopper 51 to a predetermined weight of scrap material as soon as the start switch 112 is closed.

During the dumping operation of the hopper 51 and just after it starts to return to its rest position, the limit switch LS2 is momentarily closed thus closing the circuit through the baling press operation circuit 122 and the relay coil CR2. This closes the contacts CR2 which bypasses the limit switch LS2 and thus keeps the circuit 120 closed during the operation of the baling press. When the relay coil CR2 is closed, it opens the relay contacts CR2 of the circuit 150 which prevents operation of the dump hopper until the baling press cycle, as above described, is completed.

It should be understood that the baling press operation circuit 122 has built into it a relay or a limit switch means which momentarily opens the circuit 120 when the cycle of the press has been completed. Thus upon such completion the relay coil CR2 is de-energized opening relay contacts CR2 and accordingly keeping circuit 120 open until the limit switch LS2 is momentarily closed as above described. Further, the circuit 122 can be provided with switch means for bypassing the start switch 112 so that the system can continuously be operated without prompting by the operator of the front loader 4.

It should be evident that the operator of the front loader vehicle can continuously pick up the metallic scrap material from the pad or ramp 1 and dump it into the shaker conveyor 10 from any of the three sides a, b and c. While the operator is transferring and dumping material into the shaker conveyor, the shaker conveyor 10 and the elevator conveyor 40 are continuously conveying the material and filling the hopper 51. Thus, the system permits a continuous operation of the baling press because as the baling press is going through its baling cycle, the hopper 51 is being filled and the scrap material is being transported and dumped into the hopper 10.

The completed bales 71 are fed from the baling press to a passive conveyor 70 which is so called because it does not have any actuating parts. It merely permits the bales 71 to be pushed by the cylinder 28 of the baling press 20. The conveyor 70 is elevated as shown in FIG. 2 by a cylinder 72 so that the elevation can be adjusted as the bales are loaded into different height trucks 80 or other vehicles.

If the manual mode is desired for manually starting each cycle, the selector switch 119 is moved to manual position and the start switch 112 is closed. The apparatus then proceeds through the above cycle but stops once it is completed thus requiring manual start of a new cycle.

The present system is capable of handling scrap material of various sizes such as 1, 2 or 3 foot dimensioned articles, such as fenders, car doors, rear quarter doors, engine hoods, trunk decks, and other smaller scrap materials from manufacturing plants. As previously stated, the present invention greatly increases the speed at which such material can be handled and baled. Further, the apparatus for accomplishing the same is substantially less expensive, particularly by reason of being able to utilize a front loader rather than the very expensive crane-type of loaders presently used in handling and baling metallic scrap material of the type referred to above. By utilizing radio control and this material handling apparatus, only one person is necessary to operate this entire system.

Having described my invention and the advantages thereof, it should be readily appreciated by those skilled in the art that modifications of such apparatus can be made without departing from the concepts of my invention as disclosed herein. Such modifications are to be considered as included in the following claims unless these claims by their language expressly state otherwise.

The embodiments of the invention in which an exclusive property or privilege is claimed are defined as follows:

1. A system for handling and baling metallic scrap material which comprises a baling means having a charge box with an opening on the top thereof for receiving the scrap material and a means for compacting the material into a bale, the improvement comprising a first hopper means mounted adjacent said baling means at the side thereon adjacent said opening of said charge box; means for mounting said first hopper means for movement from a loading position for receiving metallic scrap material to a dumping position in which dumping position the material in said first hopper means is dumped into said charge box through said opening; actuating means for actuating said first hopper means from said loading position to said dumping position; a weigh means for sensing the weight of said material in said hopper; actuating means for moving said hopper means from the said loading position to said dumping position, said actuating means being responsive to a predetermined weight of material sensed by said weight means; a second hopper means located at a remote position from said baling means, said second hopper means including a first conveyor means for conveying said material from a receiving end of the second hopper means to a discharge end thereof; a second conveyor means extending from said discharge end of said second hopper means to said first hopper means; the actuation of said first and second conveying means and said actuating means for said first hopper means being responsive to the weight of material sensed by said weigh means whereby when the system is in operation the conveyors are operated to discharge material into said first hopper until said predetermined weight is sensed which in response thereto said actuating means actuates said first hopper means to dumping position and said first and second conveying means become inoperative while said first hopper is in a non-loading position.

2. The system of claim 1 in which the second hopper is rectilinear and accessible for receiving material from a front loader at either of three sides at said receiving end.

3. The system of claim 1 in which the first conveyor in the second hopper is a vibrator type conveyor and the second conveyor is an endless belt-type conveyor.

4. The system of claim 3 in which the second conveyor conveys at a greater speed than the first conveyor.

5. The system of claim 1 in which the first conveyor is a vibrating type and at the discharge end of the second hopper said first conveyor has a plurality of openings through which small particles of extraneous material can pass to prevent the same from being conveyed to the said baler means.

6. The system of claim 5 in which a third conveyor is mounted under said openings at the discharge end of said first conveyor for conveying said extraneous material passing therethrough to an area for removal of the same.

7. The system of claim 1 in which the operation of said system is controllable by a control means located in a front loader vehicle.

8. The system of claim 1 in which the second hopper means has breaker elements suspended and hanging from above the first conveyor means for breaking up the scrap material to level the same and prevent jamming.

9. The system of claim 8 in which the breaker elements hang downwardly at progressively lower elevations along the path of the material being conveyed.

* * * * *